United States Patent [19]

Schraufnagel

[11] Patent Number: 4,571,300

[45] Date of Patent: Feb. 18, 1986

[54] PROCESS FOR REDUCING THE BOUND WATER CONTENT OF COAL

[75] Inventor: Richard A. Schraufnagel, Tucson, Ariz.

[73] Assignee: Atlantic Richfield Company, Los Angeles, Calif.

[21] Appl. No.: 638,833

[22] Filed: Aug. 7, 1984

[51] Int. Cl.[4] ..... F26B 3/00; C02F 1/72

[52] U.S. Cl. ..... 210/761; 44/1 G; 34/14; 210/771

[58] Field of Search ..... 210/761, 762, 774, 771, 210/770; 44/1 G, 1 R; 34/10, 14, 57 R; 110/347, 342; 60/39.05

[56] References Cited

U.S. PATENT DOCUMENTS

| | | | |
|---|---|---|---|
| 4,052,168 | 10/1977 | Koppelman | 44/1 G |
| 4,080,176 | 3/1978 | Verschuur | 44/1 G |
| 4,100,730 | 7/1978 | Pradt | 210/761 |
| 4,211,174 | 7/1980 | Martin et al. | 210/761 |
| 4,234,423 | 11/1980 | Moore et al. | 210/774 |
| 4,312,761 | 1/1982 | Gitchel | 210/761 |
| 4,338,199 | 7/1982 | Modell | 210/761 |
| 4,400,176 | 8/1983 | Kutta | 44/6 |
| 4,402,706 | 9/1983 | Wunderlich | 44/1 G |
| 4,486,959 | 12/1984 | Chang | 44/1 G |

*Primary Examiner*—Benoît Castel

*Attorney, Agent, or Firm*—F. Lindsey Scott

[57] ABSTRACT

A process for reducing the water content of coal containing bound water by treating the coal at an elevated temperature and pressure in a de-watering zone in the presence of liquid water to remove liquid water from the coal and treating liquid water in the de-watering zone or liquid water removed from the coal or both by a wet air oxidation process.

11 Claims, No Drawings

PROCESS FOR REDUCING THE BOUND WATER CONTENT OF COAL

This invention relates to processes for reducing the water content of coal containing bound water.

This invention further relates to an improvement in such processes whereby organic materials which are generally pollutants in the removed bound water are oxidized by a wet air oxidation process.

In recent years, increased attention has been directed to the production of coal of varying grades for use as a fuel as a substitute for petroleum or petroleum-derived products. Considerable attention has been directed to the production of lower rank coals for use as a fuel since such coals are typically relatively low in ash and sulfur. Further, such coals can be produced from many deposits at a low cost relative to other coals. A primary disadvantage associated with the use of such lower rank coals, i.e., such coals as brown coal, lignite, and sub-bituminous coal, has been that the coals as mined typically contain relatively high amounts of water. For instance, brown coal typically contains up to about 70 weight percent water with water contents from about 50 to about 70 weight percent being common. Lignite may contain up to as much as 50 weight percent water with water contents of about 30 to about 50 weight percent being common. Sub-bituminous coal typically contains from about 10 to about 40 weight percent water. Since many of these deposits are located at substantial distances from the locations at which the fuels are to be consumed, the transportation of the water alone represents a significant expense in the production, transportation and use of such coals. Further, the water content of the coal results in a relatively low heat content per unit weight. In other words, the heat value realized upon burning a given weight of the wet coal is much lower than would be the heat value recovered upon burning a comparable weight of dry coal. Since the heat value recovered per unit of weight is a criteria for use in many existing boiler installations, drying the coal renders it suitable for use in a larger number of existing installations than would be the case with the wet coal. For these and a variety of other reasons, it is desirable that the moisture content of lower rank coals as produced be reduced.

The water contained in coal may be present in different forms. For instance, in higher rank coal such as bituminous and anthracite coal, little of the water associated with the coal is present as chemically bound or inherent water. Rather the water present is normally surface water which is readily removed upon drying, even at relatively low temperatures for relatively short periods of time. By contrast, the water present in lower rank coal may be present as colloidal water, occlusion water, capillary water, chemically-bound water or the like (referred to herein as bound water). Such water is not readily removed by short drying periods or low temperatures. Rather it is necessary that the entire body of a coal particle be heated and held at an elevated temperature for a period of time sufficient to remove the water by evaporation. Further, it may be necessary in some instances to break chemical bonds to separate portions of the water from such coal. As a result, such drying processes are relatively expensive and more economical alternatives have been sought.

One alternative process involves the de-watering of such lower rank coals by subjecting the coal to high temperature and high pressure treatment for a period of time sufficient to release at least a portion of the bound water from the coal. Such processes are known to the art and are disclosed and discussed in many of the patents listed below which were considered in the preparation of the present application.

| Patent No. | Inventor |
|---|---|
| 4,400,176 | Kutta |
| 4,192,650 | Seitzer |
| 4,080,176 | Verschuur |
| 4,052,168 | Koppelman |
| 4,014,104 | Murphy |
| 3,992,784 | Verschuur et al. |
| 3,552,031 | Evans et al. |
| 3,007,254 | Schuster |
| 2,966,400 | Lykken |
| 2,668,099 | Cederquist |
| 2,610,115 | Lykken |
| 1,965,513 | Ruzicka |
| 1,632,829 | Fleissner |
| 1,679,078 | Fleissner |

While these references are not considered to show or suggest the present invention, they are considered to be illustrative of the state of the art and are hereby incorporated in their entirety by reference.

In the practice of such processes, large amounts of water are produced. For instance, upon reducing the water content of one ton of coal containing 60 weight percent water to a coal product containing 20 weight percent water, one thousand pounds of water is released. The water so produced typically contains substantial quantities of dissolved or dispersed organic materials. The composition of these materials may vary widely and may include solid materials, such as finely divided coal and the like. In most instances the discharge of water containing these organic materials to streams, etc., is undesirable from an environmental standpoint. As a result, it is necessary that such water be treated to produce effluent water of a suitable quality for discharge from the process. As indicated previously, large volumes of water are produced in the practice of such processes. Dissolved or dispersed organic materials are frequently present in such water in concentrations varying from about 0.2 to about 20 grams per liter as measured by the chemical oxygen demand of such aqueous streams. Higher or lower concentrations may occur in the practice of variations of the process or with different coal feedstocks and finely divided organic solids may also be associated with such aqueous streams. In any event, the relatively large volume of water containing substantial quantities of organic materials is difficult and expensive to treat by conventional waste treatment processes to produce a suitable effluent.

The practice of de-watering processes as described above for the reduction of the bound water content of low rank coals requires substantial heat. The raw coal must be heated to process conditions and then held at an elevated temperature and pressure for a substantial period of time. The heat required will vary with the particular process chosen. However, in all such processes the heat requirement is substantial.

According to the present invention, an improvement is accomplished in such de-watering processes by injecting a free oxygen containing gas into at least a portion of the liquid water streams containing organic materials at a temperature sufficient to initiate wet air oxidation of the organic materials in the water streams and in an amount sufficient to oxidize a desired quantity of the organic materials by a wet air oxidation process. By the use of the wet air oxidation process, substantial quantities of heat are generated simultaneously with the oxidation of substantial quantities of the organic materials and the volume of the liquid stream is substantially reduced.

The free oxygen-containing gas may be injected into liquid water containing organic materials in a de-watering zone.

Alternatively, the free oxygen-containing gas may be injected into a liquid water stream after separation of the liquid water stream from the de-watered coal or free oxygen-containing gas may be injected into such liquid water in a de-watering zone and into liquid water which has been separated from the de-watered coal.

In the practice of the method of the present invention, low rank coal is treated by a de-watering process whereby the coal is charged to a de-watering zone along with liquid water in an amount sufficient to provide a saturated steam atmosphere in the de-watering zone while still retaining a portion of the water in a liquid phase and thereafter maintained in the de-watering zone at a temperature of about 150° to about 350° C. at a steam pressure generally corresponding to the water temperature. The pressure is normally maintained at a level sufficient to result in liquid water being present in the de-watering zone. Reaction times of up to about 160 minutes are common, although longer times or shorter times could be used depending upon the particular coal and the amount of bound water to be released. The amount of bound water to be released can vary widely and will be a function of the treating temperature, the reaction time used and the like. Normally, at least one-third of the bound water is released in the practice of such processes.

Such de-watering processes have been described and used previously. Some such de-watering processes are discussed in:

Steam Drying of Lignite: A Review of Processes and Performance—Brian Stanmore, Dorab N. Baria and Leland E. Paulson; Grand Forks Energy Technology Center, Grand Forks, N.D.—58202 GFETC/R1-82/1.

This reference is considered to be illustrative of the state of the art with respect to such processes for the reduction of the bound water content of low rank coal.

In the practice of such de-watering processes, the bound water is removed from the structure of the coal by processes which occur in the high temperature, high pressure environment so that the water is primarily recovered by removal from the coal as liquid water. Such de-watering processes have an inherent advantage over thermal drying processes which vaporize water to dry the coal, i.e. in such de-watering processes the water is removed from the coal in a liquid form. The heat of vaporization of the water is not required in such de-watering processes. In the practice of such de-watering processes, the water is removed during the high temperature, high pressure treatment of the coal and may be separated from the de-watered coal by filtration, draining or the like before or after the de-watered coal is removed from the high temperature, high pressure de-watering zone. As a result of the high temperature in the zone, the de-watered coal product may experience surface drying as a result of flashing water from the coal surfaces upon removal from the contacting zone.

In the practice of the present invention, a free oxygen-containing gas, such as air, oxygen enriched air or oxygen may be injected into the liquid water present in the de-watering zone. Such water will typically contain dissolved or dispersed organic materials and may contain quantities of finely divided organic solids resulting from the de-watering process. The temperatures in such de-watering zones are typically high enough so that wet air oxidation processes are effective to oxidize organic materials in liquid water. Desirably the liquid water temperature is at least 200° C. after injection of the free oxygen-containing gas, but if it is desirable that injection be initiated at lower temperatures, then heated gas can be injected or the liquid water can be heated to a temperature at which the wet air oxidation reactions are effective to generate heat. After the wet air oxidation process is initiated, the oxidation of the organic materials can be used to generate heat in the de-watering zone. The amounts of oxygen injected are limited by the desired temperature increase if no steam is produced from the de-watering zone. Alternatively, if steam is produced from the de-watering zone, the temperature can be controlled by limiting the amount of injected oxygen or the amount of steam produced or both.

In the practice of present invention, the liquid water is desirably separated from the de-watered coal prior to reducing the temperature and pressure on the de-watered coal.

The liquid water stream separated from the de-watered coal is then passed to a wet air oxidation process where a free oxygen-containing gas which may be air, oxygen-enriched air, oxygen, or the like is injected into the water stream at a temperature sufficient to initiate oxidation of organic materials in the water stream. The wet air oxidation process used with the liquid water stream separated from the de-watered coal may be used whether or not a wet air oxidation process has been used in the de-watering zone.

Wet air oxidation processes are considered to be known to the art and some publications discussing such processes are:

"Earth+Wind+Air=Fire", D. F. Othmer, Mechanical Engineering, Dec. 1979, pp. 30–37;

"Wet Air Oxidation—An Alternative To Incineration", A. R. Wilhelmi, P. V. Knopp, Chemical Engineering Progress, Aug. 1979, pp 46–52;

"Wet Air Oxidation of Waste Streams", B. L. Flynn, Jr. Chemical Engineering Progress, Apr. 1979, pp 66–69;

"Wet Air Oxidation", G. H. Teletzke, Chemical Engineering Progress, Jan. 1964, pp 33–38;

"Wet Air Oxidation of Sewage Sludge", E. Hurwitz, G. H. Teletzke, W. B. Gitchel, Water and Sewage Works, Aug. 1965, pp 298–305;

"Developments in Wet Air Oxidation", L. A. Pradt Chemical Engineering Progress, Dec. 1974, pp. 72–77;

"New Processes Steal Show at Canadian Gathering", P. M. Kohn, Chemical Engineering, Nov. 1981, pp. 69–73;

"Consider Wet Oxidation", P. T. Schaefer, Hydrocarbon Processing, Oct. 1981, pp 100–104;

"Peat Combustion and Enhancement by Wet Oxidation", J. A. Bettinger, C. R. Baielod, R. A. Lanparter, Energy Progress, Dec. 1983, pp. 243–247.

Desirably the temperature in the wet air oxidation vessel after injection of the free oxygen-containing gas is at least about 200° C. In general the oxidation reaction is undesirably slow at temperatures below about 200° C.

Even the most recalcitrant compounds will usually burn below about 374° C., the critical point of water. With most organic materials, substantial equilibrium may be achieved in the wet air oxidation process at temperatures below about 250° C. Clearly, it is undesirable to use higher temperatures than necessary for the oxidation reaction unless it is desirable for other reasons such as the production of high pressure steam, the maintenance of a higher temperature in the de-watering zone, etc. The selection of the optimum temperature is clearly dependent upon many variables, such as the degree of oxidation required, the materials present, steam requirements, de-watering considerations and the like. Desirably, an amount of oxygen equal to from about 2 to about 10 percent excess oxygen, based upon complete oxidation of all the organic materials in the water stream, is used. Greater or lesser amounts of oxygen can be used if a very high percent oxidation of the organic materials is required or if a selected lesser percentage conversion is desired. Further, the amount of heat to be produced in the wet air oxidation process may influence the amount of oxygen desired. For instance, in situations where considerable amounts or organic materials are present in the water stream, if more than 5 to 7 pounds of air is required per gallon of water stream, it may be necessary to add controlled amounts of water to maintain a liquid stream. In other words, if more than about 10 percent by weight of the water stream comprises organic materials, the amount of heat liberated upon oxidation of these materials is sufficient to evaporate most if not all of the water present. For instance, the values for either wet or dry combustion vary between about 1220 Btu/pound of air for pure carbon to 1780 Btu/pound of air for hydrogen. Most organics when oxidized yield from about 1300 to about 1400 Btu/pound of air or about 5700 Btu/pound of oxygen.

If the water stream contains less organic material than required to produce the desired quantity of heat, steam or volume reduction of the stream, additional organic material can be added. Almost any type of organic material can be used including finely divided coal from the process. In such instances, the wet air oxidation process may be used primarily for heat generation with the treatment of the water stream being secondary. Wet air oxidation processes have the flexibility to permit such variations in operation.

As a result of the generation of heat coupled with the production of steam, the water stream passed to the wet air oxidation process is modified in several respects in the process. The amount of organic material contained in the water stream can be substantially reduced. The temperature of the water stream is increased significantly so that substantial quantities of steam or superheated steam may be produced for use in the process. The volume of the water stream is reduced by removal of a portion of the water as steam. The steam may be recovered as substantially pure water after it has been used for heat exchange purposes or the like. The remaining water stream will contain a reduced organic material content and in most instances such oxidized or partially oxidized residual organic materials are much more readily treated for removal than those initially present. As a result, the waste disposal problem has been greatly reduced and valuable heat has been produced for use in the de-watering process or otherwise. In some instances it is contemplated that the organic content of the stream may be reduced to a level where no further treatment is required.

According to the present invention, such wet air oxidation processes for the reduction of the bound water content of coal are synergistically combined with coal de-watering processes. In such processes a discharge water stream which must be treated for the removal of organic materials is produced at nearly the temperature and pressure required for the initiation of oxidation in the wet air oxidation process. The discharge represents a large volume stream which is difficult to treat economically by commonly used waste treatment processes. The amount of organic material in the stream is reduced, the character of the organic material is changed and the volume of the water stream is reduced by the wet air oxidation process. The reduced volume water stream is more readily treated by commonly used waste treatment processes since it may be more concentrated and since the organic materials after oxidation or partial oxidation are usually more amenable to treatment for their removal. In some instances, no additional treatment may be necessary. In addition to these advantages, the wet air oxidation process is more efficient when used in conjunction with such processes for the removal of bound water from coal than with most aqueous waste streams because of the conditions at which the water stream is passed to the wet air oxidation process. The wet air oxidation process also produces steam which can be used to supply all or a portion of the heat required for the de-watering process for the removal of bound water from coal. The combination of these two processes as discussed above results in a synergistic improvement in the combined process. While a synergistic improvement is accomplished by treating the separated bound water to reduce the amount of organic materials in the bound water and generate heat for use in the de-watering process, a further improvement is accomplished by the use of a wet air oxidation process in the de-watering zone. Temperature and pressure conditions are suitable in the de-watering zone for the use of the wet air oxidation process in the de-watering zone. The use of a wet air oxidation process in the de-watering zone can supply all or part of the heat required to maintain the desired de-watering conditions and produce steam for use in the de-watering process or for other purposes. The generation of heat in the de-watering zone without the need for external fuel or heat sources is highly desirable.

Wet air oxidation processes can be used only in the de-watering zone if desired. A substantial reduction in the amount of organic materials in the released water is accomplished and heat can be generated. Similarly as discussed above, wet air oxidation processes can be used only with the released water in a separate wet air oxidation zone. The desirable reduction of organic materials in the liquid water stream and the production of heat are readily accomplished and the process may be operated over a wider range of conditions since the de-watering zone conditions are not a constraint. If it is desirable to use the heat produced by a wet air oxidation process outside the de-watering zone for the maintenance of temperature in the de-watering zone then this heat must be transferred to the de-watering zone, whereas heat is generated in the de-watering zone when wet air oxidation is used in the de-watering zone.

It is preferred that wet air oxidation be used in both the de-watering zone and with the separated bound water stream. The use of wet air oxidation with both permits the generation of heat in the de-watering zone at conditions which are best adapted to the de-watering process and the generation of heat and a reduction of organic materials in the separated bound water with greater flexibility to meet process energy requirements and waste disposal requirements in a separate wet air oxidation process. The combination of processes can be readily varied to optimize process economics for a specific feed coal as known to those skilled in the art since both the de-watering process and the wet air oxidation process may be operated to accomplish results previously accomplished by each but in a synergistically improved total process. Clearly the combination of de-watering processes and wet air oxidation processes has resulted in a substantial improvement in the efficiency of each for its intended function and an even greater improvement in the combined process efficiency.

Having thus described the invention by reference to its preferred embodiments, it is pointed out that the embodiments described are illustrative rather than limiting in nature and that many variations and modifications are possible within the scope of the present invention. Such variations and modifications may be considered obvious and desirable by those skilled in the art based upon a review of the foregoing description of preferred embodiments.

Having thus described the invention, I claim:

1. In a de-watering process for reducing the water content of coal containing bound water by releasing at least a portion of said bound water, said process consisting essentially of treating said coal in a de-watering zone at a temperature from about 150° C. to about 350° C. in the presence of liquid water at a pressure sufficient to maintain a portion of said water in a liquid phase for a treatment time sufficient to release at lesat a portion of said bound water and discharging a liquid water stream containing at least a portion of said released bound water from said de-watering zone, an improvement comprising injecting a free oxygen-containing gas into at least a portion of said liquid water in said de-watering zone at a temperature sufficient to initiate oxidation of organic materials in said liquid water and in an amount sufficient to oxidize a desired quantity of said organic materials by a wet air oxidation process.

2. The improvement of claim 1 wherein said liquid water is at a temperature of at least about 200° C. after injection of said free oxygen-containing gas.

3. The improvement of claim 2 wherein said temperature of said liquid water is from about 250° C. to about 350° C.

4. The improvement of claim 1 wherein said free oxygen-containing gas is injected into said liquid water stream discharged from said de-watering zone at a temperature sufficient to initiate oxidation of organic materials in said liquid water and in an amount sufficient to oxidize a desired quantity of said organic materials by a wet air oxidation process.

5. The improvement of claim 4 wherein said liquid water stream is passed to a wet air oxidation zone and wherein said liquid water stream is at a temperature of at least about 200° C. after injection of said free oxygen-containing gas and at a pressure sufficient to maintain at least a portion of said liquid water stream in a liquid phase.

6. The improvement of claim 5 wherein said temperature is from about 250° C. to about 350° C.

7. The improvement of claim 5 wherein steam is produced by said wet air oxidation process for use in said de-watering process.

8. A de-watering process for reducing the water content of coal containing bound water, said process comprising:

(a) charging said coal to a de-watering zone;

(b) maintaining said coal in said de-watering zone at a temperature from about 150° C. to about 350° C. in the presence of liquid water at a pressure sufficient to maintain a portion of said water in a liquid phase for a treatment time sufficient to release at least a portion of said bound water;

(c) injecting a free oxygen-containing gas into said liquid water in said de-watering zone at a temperature sufficient to initiate oxidation of organic materials in said liquid water stream and in an amount sufficient to oxidize a desired quantity of said organic materials by a wet oxidation process; and, (d) separating a liquid water stream from said coal.

9. The process of claim 8 wherein said liquid water stream is at a temperature of at least about 200° C. after injection of said free oxygen-containing gas.

10. The process of claim 8 wherein said temperature of said water stream is from about 250° C. to about 350° C.

11. The process of claim 8 wherein said free oxygen containing gas is injected into said liquid water stream separated from said coal at a temperature sufficient to initiate oxidation of organic materials in said liquid water stream separated from said coal to oxidize a desired quantity of said organic material by a wet air oxidation process.

* * * * *

UNITED STATES PATENT AND TRADEMARK OFFICE

CERTIFICATE OF CORRECTION

PATENT NO. : 4,571,300

DATED : February 18, 1986

INVENTOR(S) : Richard A. Schraufnagel

It is certified that error appears in the above-identified patent and that said Letters Patent is hereby corrected as shown below:

On the last page, Column 7, line 34, "lesat" should read --least--.

On the last page, Column 8, line 35, after "wet" please insert --air--.

Signed and Sealed this

*Twenty-fourth* Day of *June 1986*

[SEAL]

*Attest:*

DONALD J. QUIGG

*Attesting Officer*

*Commissioner of Patents and Trademarks*